US011690144B2

(12) United States Patent
Okoniewski et al.

(10) Patent No.: US 11,690,144 B2
(45) Date of Patent: Jun. 27, 2023

(54) APPARATUS AND METHODS FOR TRANSPORTING SOLID AND SEMI-SOLID SUBSTANCES

(71) Applicant: Acceleware Ltd., Calgary (CA)

(72) Inventors: Michal M. Okoniewski, Calgary (CA); Geoffrey Clark, Calgary (CA)

(73) Assignee: Accelware Ltd., Calgary (CA)

( * ) Notice: Subject to any disclaimer, the term of this patent is extended or adjusted under 35 U.S.C. 154(b) by 0 days.

(21) Appl. No.: 17/437,090

(22) PCT Filed: Mar. 9, 2020

(86) PCT No.: PCT/CA2020/050312
§ 371 (c)(1),
(2) Date: Sep. 8, 2021

(87) PCT Pub. No.: WO2020/181368
PCT Pub. Date: Sep. 17, 2020

(65) Prior Publication Data

US 2022/0167471 A1 May 26, 2022

Related U.S. Application Data

(60) Provisional application No. 62/816,262, filed on Mar. 11, 2019.

(51) Int. Cl.
*H05B 6/62* (2006.01)

(52) U.S. Cl.
CPC ..... *H05B 6/62* (2013.01)

(58) Field of Classification Search
CPC ..... H05B 6/62; H05B 6/108; H05B 2214/03
(Continued)

(56) References Cited

U.S. PATENT DOCUMENTS 2,757,738 A 8/1956 Ritchey
3,169,577 A 2/1965 Sarapuu
(Continued)

FOREIGN PATENT DOCUMENTS

CA 2816101 A1 5/2012
CA 2816297 C 5/2017
(Continued)

OTHER PUBLICATIONS

International Search Report and Written Opinion dated Jun. 3, 2020 in International Patent Application No. PCT/CA2020/050312 (8 pages).

*Primary Examiner* — Dana Ross
*Assistant Examiner* — Joe E Mills, Jr.
(74) *Attorney, Agent, or Firm* — Bereskin & Parr LLP/S.E.N.C.R.L., s.r.l.; Isis E. Caulder; Maria Wei

(57) ABSTRACT

An apparatus and method for transporting solid and semi-solid substances. The apparatus includes at least one transport container for storing the substances. The transport container includes at least two transmission line conductors configurable to be in physical contact with the substances. The transmission line conductors are excitable to operate as a lossy transmission line for electromagnetically heating the substances prior to unloading from the transport container. The method involves loading the substances in at least one transport container, each of the at least one transport container including at least two transmission line conductors configurable to be in physical contact with the substances; transporting the at least one transport container from a first location to a second location; and exciting the at least two transmission line conductors to operate as a lossy transmission line for electromagnetically heating the substances prior to unloading from the at least one transport container.

27 Claims, 6 Drawing Sheets

(58) Field of Classification Search
USPC ..... 219/770
See application file for complete search history.

(56) References Cited

U.S. PATENT DOCUMENTS

| | | | | |
|---|---|---|---|---|
| 3,170,519 | A | | 2/1965 | Haagensen |
| 3,522,848 | A | | 8/1970 | New |
| 4,135,579 | A | | 1/1979 | Rowland et al. |
| 4,140,179 | A | | 2/1979 | Kasevich et al. |
| 4,140,180 | A | | 2/1979 | Bridges et al. |
| 4,144,935 | A | | 3/1979 | Bridges et al. |
| 4,193,451 | A | | 3/1980 | Dauphine |
| 4,301,865 | A | | 11/1981 | Kasevich et al. |
| 4,319,632 | A | | 3/1982 | Marr, Jr. |
| 4,320,801 | A | | 3/1982 | Rowland et al. |
| 4,370,534 | A | | 1/1983 | Brandon |
| 4,408,117 | A | * | 10/1983 | Yurkanin ..... F24H 1/185 219/202 |
| 4,449,585 | A | | 5/1984 | Bridges et al. |
| 4,470,459 | A | | 9/1984 | Copland |
| 4,487,257 | A | | 12/1984 | Dauphine |
| 4,508,168 | A | | 4/1985 | Heeren |
| 4,513,815 | A | | 4/1985 | Rundell et al. |
| 4,583,589 | A | | 4/1986 | Kasevich |
| 4,620,593 | A | | 11/1986 | Haagensen |
| 4,973,811 | A | * | 11/1990 | Bass ..... E21B 43/2401 166/248 |
| 5,293,936 | A | | 3/1994 | Bridges |
| 6,189,611 | B1 | | 2/2001 | Kasevich |
| 6,285,014 | B1 | | 9/2001 | Beck et al. |
| 6,453,739 | B1 | | 9/2002 | Saikalis |
| 7,075,392 | B2 | | 7/2006 | Smith et al. |
| 7,312,428 | B2 | | 12/2007 | Kinzer |
| 7,817,101 | B2 | | 10/2010 | Cowles |
| 7,891,421 | B2 | | 2/2011 | Kasevich |
| 8,648,760 | B2 | | 2/2014 | Parsche |
| 8,763,691 | B2 | | 7/2014 | Parsche |
| 8,789,599 | B2 | | 7/2014 | Parsche |
| 9,521,707 | B2 | | 12/2016 | Weerapakkaroon et al. |
| 9,938,809 | B2 | | 4/2018 | Okoniewski et al. |
| 10,760,392 | B2 | | 9/2020 | Okoniewski et al. |
| 10,774,629 | B2 | | 9/2020 | Okoniewski et al. |
| 2001/0011590 | A1 | | 8/2001 | Thomas et al. |
| 2004/0084442 | A1 | | 5/2004 | La Rovere |
| 2006/0102625 | A1 | | 5/2006 | Kinzer |
| 2007/0252568 | A1 | | 11/2007 | Chien |
| 2009/0173488 | A1 | | 7/2009 | Varma |
| 2011/0006055 | A1 | | 1/2011 | Diehl |
| 2011/0042063 | A1 | | 2/2011 | Diehl et al. |
| 2011/0094755 | A1 | | 4/2011 | Corbett et al. |
| 2011/0253367 | A1 | | 10/2011 | Banerjee et al. |
| 2011/0303423 | A1 | | 12/2011 | Kaminsky et al. |
| 2012/0018140 | A1 | | 1/2012 | Parsche |
| 2012/0067580 | A1 | | 3/2012 | Parsche |
| 2012/0118565 | A1 | | 5/2012 | Trautman et al. |
| 2012/0125609 | A1 | | 5/2012 | Parsche |
| 2012/0132639 | A1 | | 5/2012 | Hashimoto |
| 2012/0248099 | A1 | | 10/2012 | Nadarajah et al. |
| 2013/0192825 | A1 | | 8/2013 | Parsche |
| 2014/0131032 | A1 | | 5/2014 | Dittmer |
| 2014/0262225 | A1 | | 9/2014 | Campbell et al. |
| 2014/0290934 | A1 | | 10/2014 | Parsche |
| 2015/0013967 | A1 | | 1/2015 | Parsche |
| 2016/0047213 | A1 | | 2/2016 | Grounds, III et al. |
| 2017/0008537 | A1 | | 1/2017 | Hoffman |

FOREIGN PATENT DOCUMENTS

| | | | |
|---|---|---|---|
| CN | 206798288 | U | 12/2017 |
| EP | 1779938 | A2 | 5/2007 |
| WO | 2008/115359 | A1 | 9/2008 |
| WO | 2012/067769 | A2 | 5/2012 |

* cited by examiner

APPARATUS AND METHODS FOR TRANSPORTING SOLID AND SEMI-SOLID SUBSTANCES

CROSS-REFERENCE TO RELATED APPLICATION

This application is a 35 USC § 371 national stage entry of International Patent Application No. PCT/CA2020/050312, filed Mar. 9, 2020, which claims priority from U.S. Provisional Patent Application Ser. No. 62/816,262, filed Mar. 11, 2019; the entire contents of each of which are hereby incorporated by reference.

FIELD

The embodiments described herein relate to transporting solid and semi-solid substances, and in particular to apparatus and methods of electromagnetically heating solid and semi-solid substances for transport.

BACKGROUND

Hydrocarbons (i.e., crude oil, bitumen) are transported long distances from source to market for consumption. In the absence of new pipeline construction, the capacity of existing pipeline infrastructure is insufficient for pipeline transport to meet the demands of the oil industry. Hydrocarbons can also be transported by rail or ship.

However, such modes of transport are expensive, adding a significant economic factor. For example, hydrocarbons can be mixed with diluents for transport by rail or ship. There are costs associated with mixing the diluent with the hydrocarbon, separating the diluent from the hydrocarbon, and return shipping of the diluent to the source for further use. In addition, some existing methods for transporting bitumen involve using of steam to heat bitumen.

Furthermore, such modes of transport are also associated with significant disadvantages. For example, the transport of diluted bitumen presents significant real and perceived fire and/or explosion risks. Transporting bitumen by ship is perceived as risky, not least due to the potential of spills if tankers are damaged. As well, steam-based methods for heating bitumen relies on thermal conduction, which can take a long time and be energy inefficient.

In addition to hydrocarbons, it can be safer and/or more economical to transport other liquid substances in solid or semi-solid form and to heat the substance for unloading. For example, hazardous materials such as caustic products can be transported in solid or semi-solid form to reduce the risk of unintended reactions.

SUMMARY

The various embodiments described herein generally relate to apparatus (and associated methods) for transporting solid and semi-solid substances. The apparatus includes at least one transport container for storing the substance. The transport container includes at least two transmission line conductors configurable to be in physical contact with the substance. The at least two transmission line conductors are excitable to operate as a lossy transmission line for electromagnetically heating the substance prior to unloading the substance from the transport container.

In any embodiment, electromagnetically heating the substance may involve transmitting electromagnetic energy to the substance to heat the substance volumetrically.

In any embodiment, the transport container may be closable.

In any embodiment, the at least two transmission line conductors may include at least one electrode positionable in the transport container.

In any embodiment, the transport container may be formed of a conductive material to provide electromagnetic shielding for the lossy transmission line.

In any embodiment, the at least one electrode positionable in the transport container may include at least a first electrode that is electrically grounded and at least a second electrode excitable by at least a first energizing signal.

In any embodiment, the at least a second electrode excitable by at least a first energizing signal may further include at least a third electrode excitable by at least a second energizing signal. The second energizing signal may be the first energizing signal with a 180° phase shift.

In any embodiment, the at least one electrode positionable in the transport container may include at least a first electrode excitable by at least a first energizing signal and at least a second electrode excitable by at least a second energizing signal. The second energizing signal may be the first energizing signal with a 180° phase shift.

In any embodiment, the at least one electrode positionable in the transport container may include at least a heating portion of the at least one electrode being immersed in the substance when the at least one electrode is positioned in the transport container.

In any embodiment, the at least one electrode may include at least one connecting portion located outside of the transport container when the electrode is positioned in the transport container.

In any embodiment, the at least one electrode may include a transition portion for coupling the heating portion to the connecting portion. The transition portion may enter the transport container above a pre-determined level within the transport container when the electrode is positioned in the transport container.

In any embodiment, the apparatus may further include insulating material around at least the transition portion of each of the at least one electrode.

In any embodiment, the apparatus may further include insulating material around at least the heating portion of each of the at least one electrode.

In any embodiment, the at least two transmission line conductors may include the transport container. The transport container may be formed of a conductive material.

In any embodiment, the at least one transport container may include a plurality of transport containers. The apparatus may further include at least one intermediary connection for coupling the at least two transmission line conductors of at least a pair of transport containers in either a series connection or a parallel connection.

In any embodiment, the at least one intermediary connections for coupling the at least two transmission line conductors may include a plurality of intermediary connections for coupling the at least two transmission line conductors of a plurality of transport containers in series connections to lengthen the lossy transmission line.

In any embodiment, a total length of the lossy transmission line may be at least 50 meters.

In any embodiment, the at least one intermediary connection may further include at least one of an electrical short, an electrical open, an inductive component, a capacitive component, and a reactive network to achieve a desired reactive profile along the length of the lossy transmission line.

In any embodiment, the apparatus may further include at least one of an electrical short, an electrical open, an inductive component, a capacitive component, and a reactive network at a terminal end of the lossy transmission line to achieve a desired reflection profile at the termination of the lossy transmission line.

In any embodiment, the apparatus may further include at least one electromagnetic wave generator couplable to the at least two transmission line conductors for exciting the at least two transmission line conductors.

In any embodiment, the at least one electromagnetic wave generator may be transportable with the at least one transport container.

In any embodiment, the transport container may be electrically grounded to a common ground as the at least one electromagnetic wave generator.

In any embodiment, the apparatus may further include at least one high voltage cable for coupling the at least one electromagnetic wave generator to the at least two transmission line conductors.

In any embodiment, the apparatus may further include an electrical power source couplable to the at least one electromagnetic wave generator for supplying electrical power to the at least one electromagnetic wave generator.

In any embodiment, the electrical power source may be transportable with the at least one transport container.

In any embodiment, the electrical power source may include at least one of an electric generator and a power converter for converting excess power to the electrical power supplied to the at least one electromagnetic wave generator.

In any embodiment, the substance may further include an additive for at least one of increasing conductivity and increasing dielectric losses.

In any embodiment, the substance may be hydrocarbons.

In any embodiment, the substance may be caustic.

In a broad aspect, a method may involve loading the substance in at least one transport container. Each of the at least one transport container can include at least two transmission line conductors configurable to be in physical contact with the substance. The method may also involve transporting the at least one transport container from a first location to a second location; and exciting the at least two transmission line conductors to operate as a lossy transmission line for electromagnetically heating the substance prior to unloading the substance from the at least one transport container.

In any embodiment, electromagnetically heating the substance may involve transmitting electromagnetic energy to the substance to heat the substance volumetrically.

In any embodiment, loading the substance in at least one transport container may further involve closing the transport container after the transport container is loaded.

In any embodiment, loading the substance in at least one transport container may involve filling the transport container to a level less than a pre-determined level within the transport container.

In any embodiment, exciting the at least two transmission line conductors may involve positioning at least one electrode in the transport container.

In any embodiment, positioning at least one electrode in the transport container may involve positioning at least a first electrode and a second electrode in the transport container; electrically grounding at least the first electrode; and exciting at least the second electrode by at least a first energizing signal.

In any embodiment, positioning at least one electrode in the transport container may further involve positioning at least a third electrode in the transport container; and exciting at least the third electrode by at least a second energizing signal. The second energizing signal may be the first energizing signal with a 180° phase shift.

In any embodiment, positioning at least one electrode in the transport container may involve positioning at least a first electrode and a second electrode in the transport container; exciting at least the first electrode by at least a first energizing signal; and exciting at least the second electrode by at least a second energizing signal. The second energizing signal may be the first energizing signal with a 180° phase shift.

In any embodiment, positioning at least one electrode in the transport container may involve immersing at least a heating portion of the at least one electrode in the substance.

In any embodiment, loading the substance in the at least one transport container may involve loading the substance in a plurality of transport containers and coupling the at least two transmission line conductors of at least a pair of transport containers in either a series connection or a parallel connection.

In any embodiment, coupling the at least two transmission line conductors of at least a pair of transport containers may involve coupling the at least two transmission line conductors of a plurality of transport containers in series connections to lengthen the lossy transmission line.

In any embodiment, coupling the at least two transmission line conductors of at least a pair of transport containers may further involve providing at least one of an electrical short, an electrical open, an inductive component, a capacitive component, and a reactive network in the connection between the pair of transport containers to achieve a desired reactive profile along the length of the lossy transmission line.

In any embodiment, coupling the at least two transmission line conductors of at least a pair of transport containers may further involve providing at least one of an electrical short, an electrical open, an inductive component, a capacitive component, and a reactive network at a terminal end of the lossy transmission line to achieve a desired reflection profile at the termination of the lossy transmission line.

In any embodiment, exciting the at least two transmission line conductors may involve coupling at least one electromagnetic wave generator to the at least two transmission line conductors.

In any embodiment, coupling at least one electromagnetic wave generator to the at least two transmission line conductors may involve electrically grounding the transport container to a common ground of the at least one electromagnetic wave generator.

In any embodiment, the at least one electromagnetic wave generator may be located at the second location; and coupling the at least one electromagnetic wave generator to the at least two transmission line conductors may be performed at the second location.

In any embodiment, exciting the at least two transmission line conductors may involve coupling an electrical power source located at the second location to the at least one electromagnetic wave generator coupled to the at least two transmission line conductors.

In any embodiment, electromagnetically heating the substance may be performed during at least a portion of the transportation of the at least one transport container between the first location and the second location.

In any embodiment, exciting the at least two transmission line conductors may involve converting excess power to electrical supply power for the at least one electromagnetic wave generator.

In any embodiment, loading the substance in at least one transport container may further involve providing an additive for at least one of increasing conductivity and increasing dielectric losses.

In any embodiment, the substance may be hydrocarbons.

In any embodiment, the substance may be caustic.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
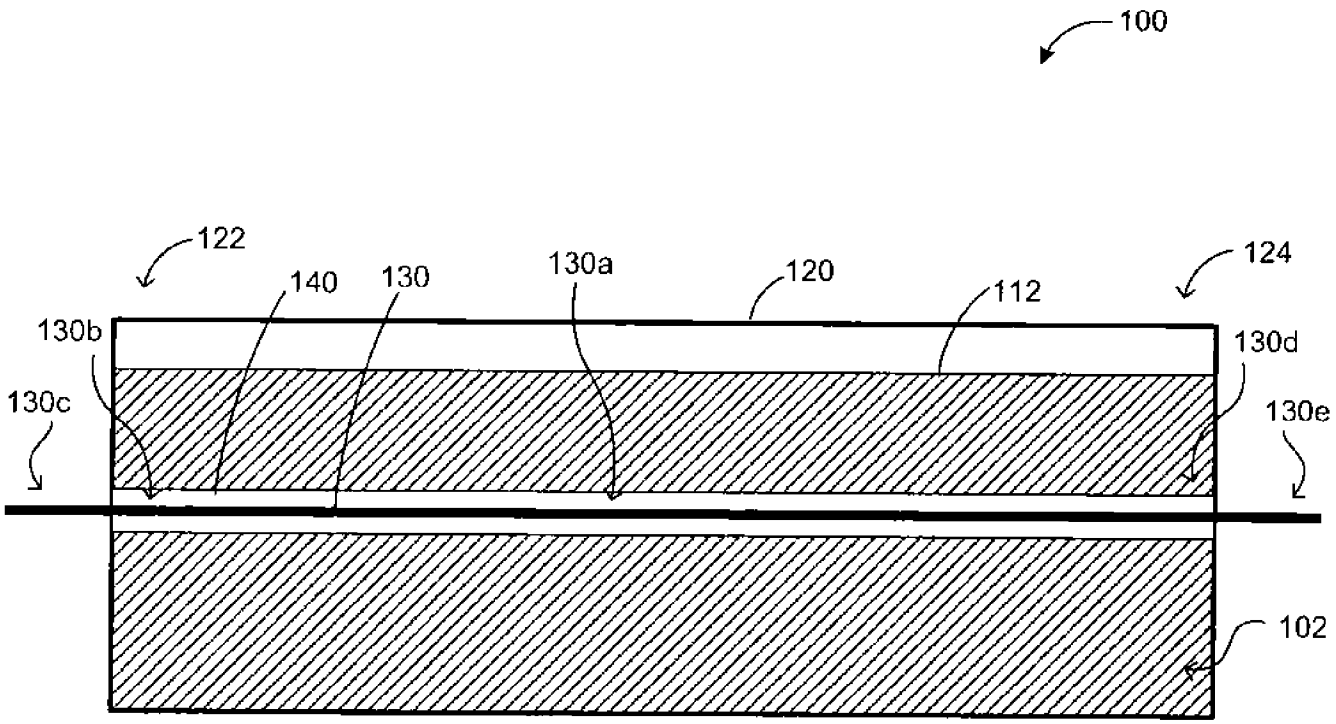
FIG. 1 is side profile view of an example apparatus for transporting hydrocarbons, according to at least one embodiment.

The skilled person in the art will understand that the drawings, described below, are for illustration purposes only. The drawings are not intended to limit the scope of the applicants' teachings in any way. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that the term "coupled" used herein indicates that two elements can be directly coupled to one another or coupled to one another through one or more intermediate elements.

The term radio frequency when used herein is intended to extend beyond the conventional meaning of radio frequency. The term radio frequency is considered here to include frequencies at which physical dimensions of system components are comparable to the wavelength of the electromagnetic (EM) wave. System components that are less than approximately 10 wavelengths in length can be considered comparable to the wavelength. For example, a 1 kilometer (km) long system that uses EM energy to heat hydrocarbons and operates at 50 kilohertz (kHz) will have physical dimensions that are comparable to the wavelength. If the hydrocarbons has significant water content (herein referred to as "wet") (e.g., relative electrical permittivity being approximately 60 and conductivity being approximately 0.002 S/m), the EM wavelength at 50 kHz is 303 meters. The length of the 1 km long radiator is approximately 3.3 wavelengths. If the hydrocarbons is dry (e.g., relative electrical permittivity being approximately between 4-6 and conductivity being approximately 3E-7 S/m), the EM wavelength at 50 kHz is between 2450-3000 meters. The length of the radiator is then approximately 0.33 and 0.4 wavelengths—a substantial fraction of a wavelength. Therefore in both wet and dry scenarios, the length of the radiator is comparable to the wavelength. Accordingly, effects typically seen in conventional RF systems will be present and while 50 kHz is not typically considered RF frequency, this system is considered to be an RF system. As the frequency is increased, similar effects can be observed with shortened radiator lengths. Selection of operating frequencies, or operating frequency range is one of the operable parameters to obtain a desired effect.

Referring to FIG. 1, shown therein is a side profile view of an apparatus 100 for transporting hydrocarbons, according to at least one embodiment. The apparatus 100 includes a transport container 120 for storing the hydrocarbons 102.

The apparatus 100 can be used for transporting hydrocarbons 102. The hydrocarbons 102 can be cooled down or a semi-solid material during transport. For example, the hydrocarbons 102 can be pure, undiluted, bitumen, which is less of a fire and/or explosion risk than that of diluted bitumen. Pure bitumen has low conductivity and does not interact with electromagnetic energy efficiently. In at least one embodiment, an additive can be added to the hydrocarbons 102 to increase conductivity and/or increase dielectric losses. The additive can be a solid substance. For example, small amounts of electrically conductive materials that do not interfere with bitumen refining processes could be added, such as nickel or carbon black. The hydrocarbons 102 can be heated to a liquid state for unloading from the transport container 120.

The transport container 120 can be any appropriate container for storing hydrocarbons 102. For example, the transport container 120 can be a shipping container. The transport container 120 has a first end 122 and a second end 124. Hydrocarbons 102 can be loaded into the transport container 120 to a surface level of 112. In at least one embodiment, the transport container 120 may have a pre-determined maximum level to which the hydrocarbons 102 can be loaded. That is, hydrocarbons 102 can be loaded up to the pre-determined maximum level of the transport container 120.

In at least one embodiment, the transport container 120 can be open or closed. That is, the transport container 120 can have an open-top and remain open during transit. However, such embodiments can increase the risk of leakage of hydrocarbons 102.

The transport container 120 can be loaded on a transport vehicle, such as a ship (e.g., tanker, container ship), train car (e.g., train car for receiving shipping containers), or truck for transport. Alternatively, the transport container 120 can serve as the transport vehicle itself, such as a rail car. For example, the transport container 120 can be a DOT-111 tank car, or TC-111 tank car.

The transport container 120 includes at least two transmission line conductors. In apparatus 100, the at least two transmission line conductors are provided by an electrode 130 and the transport container 120, itself.

At least one excitation, or energizing signal can be applied to the at least two transmission line conductors to excite the at least two transmission line conductors. More specifically, a high frequency alternating current can be applied to the electrode 130 and the transport container 120. The high frequency alternating current can have a frequency between about 1 kilohertz (kHz) to about 10 megahertz (MHz).

When excited, the at least two transmission line conductors can form a transmission line between the electrode 130 and the transport container 120. The transmission line can carry electromagnetic energy in a cross-section of a radius comparable to a wavelength of the excitation signal. The transmission line can propagate an electromagnetic wave from a first end 122 of the transport container 120 to a second end 124 of the transport container 120. In at least one embodiment, the electromagnetic wave may propagate as a standing wave. In at least one other embodiment, the electromagnetic wave may propagate as a partially standing wave. In yet at least one other embodiment, the electromagnetic wave may propagate as a travelling wave.

The hydrocarbons 102 can act as a dielectric medium for the transmission line. The transmission line can carry and dissipate energy within the dielectric medium, that is, the hydrocarbons 102. Thus, the transmission line formed by transmission line conductors can be considered a lossy transmission line. The dissipation of energy within the hydrocarbons 102 can heat the hydrocarbons 102. More specifically, the lossy transmission line can transmit electromagnetic energy into the hydrocarbons 102 to heat the hydrocarbons 102 volumetrically. Volumetrically heating hydrocarbons 102 can be faster than conventional steam-based methods of heating hydrocarbons 102, which relies upon thermal conduction, that is, surface heating. In addition, electromagnetically heating the hydrocarbons 102 can be more energy efficient, resulting in lower greenhouse gas emissions than conventional steam-based methods of heating hydrocarbons 102.

When the transport container 120 and the electrode 130 serve as the at least two transmission line conductors, the transmission line is provided by a coaxial transmission line having an inner conductor, an outer conductor, and a dielectric therein between. That is, the electrode 130 provides the inner conductor of the coaxial transmission line, the transport container 120 provides the outer conductor, and the hydrocarbons 102 provide the dielectric therein between.

As noted above, in apparatus 100, the transport container 120 can serve as one of the at least two transmission line conductors. In such cases, the transport container 120 is formed of a conductive material. As well, the transport container 120 can be insulated.

In apparatus 100, the transport container 120 includes an electrode 130 positionable in the transport container 120. When the electrode 130 is positioned in the transport container 120 with the hydrocarbons 102 loaded therein, the electrode 130 is immersed in and in physical contact with the hydrocarbons 102. The electrode 130 can be a conductor rod, a pipe (including coiled tubing) or any other conductor to transmit EM energy.

As shown in FIG. 1, the electrode 130 is substantially linear and when positioned within the transport container, the electrode 130 extends horizontally, between the first end 122 of the transport container 120 to the second end 124 of the transport container 120. In at least one embodiment, the electrode 130 can have a non-linear shape, including bends or curves. Furthermore, the electrode 130 can extend vertically between the top of the transport container 120 and the bottom of the transport container 120.

With a substantially linear and horizontal shape, the electrode 130 is positioned to share a geometric axis with the transport container 120. That is, the position of the electrode 130 can be concentric with the transport container 120. In at least another embodiment, the electrode 130 can be positioned at half of the pre-determined maximum level of the hydrocarbons 102. That is, the position of the electrode 130 can be concentric with the hydrocarbons 102. In at least another embodiment, the electrode 130 is asymmetrical in relation to the level of the hydrocarbons 102 and the transport container 120. As well, the electrode 130 can be asymmetrical in relation to the width to the transport container 120. It can be advantageous for the electrode 130 to be located in the bottom half of the transport container 120 for more convenient unloading of hydrocarbons 102 and for improved convection heating of the hydrocarbons 102.

In at least one embodiment, the transport container 120 can include one or more support members to provide structural support of the electrode 130. The support members can include posts and/or hangers. Furthermore, the support members can be insulated.

As shown in FIG. 1, the electrode 130 includes a heating portion 130*a* that is located in the transport container 120 and in physical contact with the hydrocarbons 102, connecting portions 130*c*, 130*e* that are located outside of the transport container 120, and transition portions 130*b*, 130*d* that traverse, or pass through the transport container 120 for connecting the heating portion 130*a* to the connecting portions 130*c*, 130*e*, respectively. In apparatus 100, the transition portions 130*b*, 130*d* of the electrode 130 are located below the surface level 112 of the hydrocarbons 102. In at least one embodiment, one or both of the transition portions 130*b*, 130*d* can be located above the surface level 112 of the hydrocarbons 102 to reduce the risk of leakage of hydrocarbons 102 from the transport container 120 as the transition portions 130*b*, 130*d* pass through the transport container 120.

In at least one embodiment, the transition portions 130*b*, 130*d* of the electrode 130 can be located at the same end of the transport container 120. For example, the electrode 130 can enter the transport container 120 at the first end 122, extend to the second end 124, include a u-shape at the second end 124, and extend to the first end 122. In at least one embodiment, the electrode 130 may include only one connecting portion 130*c*, and as a result, only include one transition portion 130*b*. That is, the electrode 130 may include only one terminal end.

In at least one embodiment, the electrode 130 can be fixedly attached within the transport container 120. In such cases, the electrode 130 remains attached during loading, transport, and unloading of hydrocarbons 102 in the transport container 120. In at least another embodiment, the electrode 130 can be removably attached to the transport container 120. In such cases, the electrode 130 can be removed for loading and/or unloading of hydrocarbons 102, and re-attached for heating.

The electrode 130 of apparatus 100 is shown in FIG. 1 as being insulated 140. In particular, the electrode 130 is fully insulated. That is, the electrode 130 is insulated along the entire length of the heating portion 130*a* and transition portions 130*b*, 130*d* of the electrode 130. In at least one embodiment, the electrode 130 can be partially insulated. For example, only the heating portion 130*a* may be insulated, only part of the heating portion 130*a* may be insulated, and/or only the transition portions 130*b*, 130*d* may be insulated. It can be advantageous to insulate the transition portions 130*b*, 130*d* to reduce the risk of leakage of hydrocarbons 102.

It should be noted that FIG. 1 is provided for illustrative purposes only and other configurations are possible. For example, transport container 120 can have a rectangular prism shape, a cylindrical shape (e.g., vertical or horizontal), or any other appropriate shape. As well, while only one electrode 130 is shown in FIG. 1, it will be understood transport container 120 can include additional electrodes. For example, transport container 120 can include two electrodes that are spaced apart horizontally (i.e., a first electrode beside a second electrode), vertically (i.e., a first electrode above a second electrode), and/or both.

Figure 2:
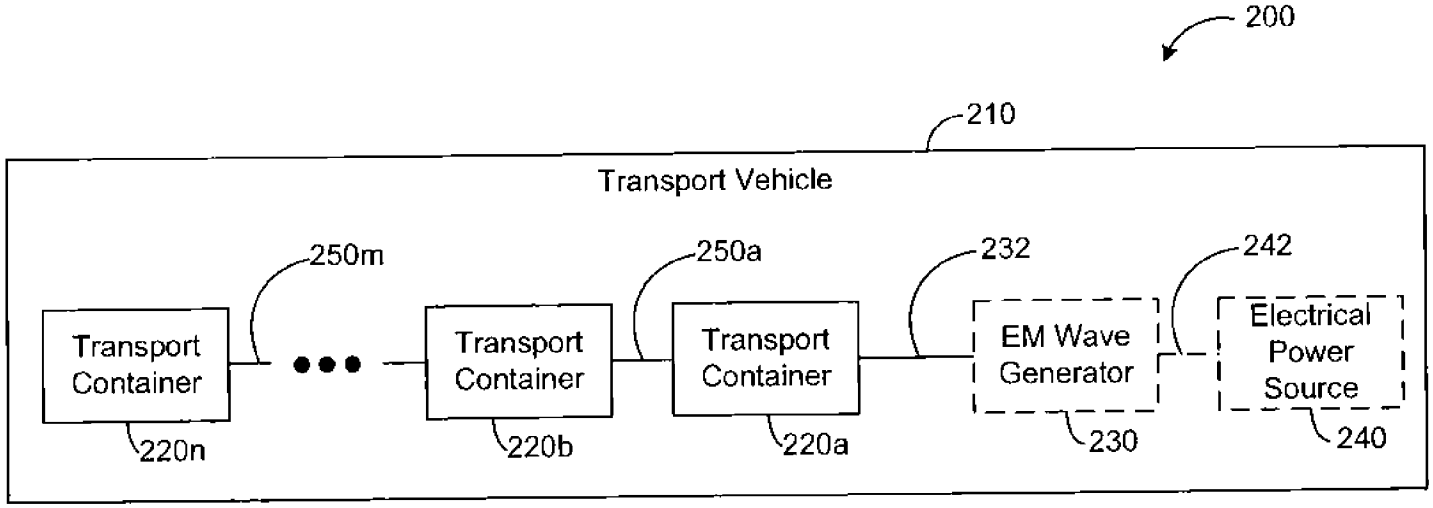
FIG. 2 is a schematic view of another example apparatus including a plurality of daisy-chained transport containers, according to at least one embodiment.

Referring to FIG. 2, shown therein is a schematic view of an apparatus 200 for transporting hydrocarbons, according to at least another embodiment. The apparatus 200 includes a plurality of transport containers 220*a*, 220*b* . . . 220*n* (herein collectively referred to as transport containers 220). One or more of the transport containers 220 can be, for example, transport container 120 of FIG. 1.

The plurality of transport containers 220 can be transported together. As shown in FIG. 2, the plurality of transport containers 220 can be located on a transport vehicle 210. In at least another embodiment, the plurality of transport containers 220 can be rail cars coupled together.

Intermediary connections can be provided to couple the at least two transmission line conductors of a pair of transport containers 220 together in either a series connection or a parallel connection. Each of the intermediary connections can be provided by high voltage cables. The high voltage cables can be shielded. Furthermore, the shielding of a plurality of high voltage cables can be connected to a common ground to prevent current from travelling in a direction opposite to the lossy transmission line. That is, to prevent current from returning to the electromagnetic (EM) wave generator 230. As shown in FIG. 2, intermediary connection 250*a* of apparatus 200 couples transmission line conductors of transport containers 220*a* and 220*b* in a series connection, that is, "daisy chained" together.

In apparatus 200, a plurality of intermediary connections 250*a*, 250*b* . . . 250*m* (herein collectively referred to as intermediary connections 250) couple the at least two transmission line conductors of each of the plurality of transport containers 220 together in series connections (e.g., daisy chained). As a result, the at least two transmission line conductors of each of the plurality of transport containers 220 form a single lossy transmission line and hydrocarbons 102 in the plurality of transport containers 220 can be heated simultaneously. Furthermore, the plurality of series intermediary connections 250 lengthens the lossy transmission line. In at least one embodiment, the total length of a lossy transmission line formed by a plurality of transport containers 220 connected by series intermediary connections 250 can be at least 50 meters. In some embodiments, the total length of a lossy transmission line formed by a plurality of transport containers 220 connected by series intermediary connections 250 can be in the range of about 50 meters to about 1500 meters.

One or more of the intermediary connections 250 can include electrical components to achieve a desired reactive profile and/or a desired heating pattern along the length of the lossy transmission line. For example, an intermediary connection 250 can include an electrical short, an electrical open, an inductive component, a capacitive component, and/or a reactive network. A desired reactive profile can adjust the impedance seen by the EM wave generator 230. A desired heating pattern can, for example, be effected by selectively shaping a standing or a partially standing wave propagated along the lossy transmission line. For example, the standing or partially standing wave can be shaped such that nodes of the standing or partially standing wave coincide with the intermediary connections 250 of the plurality of transport containers 220 because hydrocarbons 102 are not present at the intermediary connections 250.

Although not shown in FIG. 2, apparatus 200 can also include electrical components at a terminal end of the lossy transmission line to achieve a desired reflection profile from the termination of the lossy transmission line. That is, electrical components can be provided at a terminal end of the plurality of transport containers 220. A desired reflection profile can limit the electromagnetic power reflected at the termination of the lossy transmission line and back to the EM wave generator 230. For example, in apparatus 200, electrical components can be provided at a terminal end of transport container 220*n*. Electrical components can include an electrical short, an electrical open, an inductive component, a capacitive component, and/or a reactive network.

As described above, the at least two transmission line conductors of the lossy transmission line can be excited to electromagnetically heat the hydrocarbons 102 prior to unloading the hydrocarbons 102 from the transport container 220. One or more excitation or energizing signals can be used to excite the transmission line conductors.

In at least one embodiment, at least a first transmission line conductor of the lossy transmission line can be electrically grounded and at least a second transmission line conductor can be excited by a first energizing signal.

In at least one embodiment, at least a first transmission line conductor of the lossy transmission line can be excited by a first energizing signal and at least a second transmission line conductor can be excited by a second energizing signal. The second energizing signal can be the first energizing signal with a phase shift. The phase shift can be any appropriate phase difference. For example, the phase shift can be approximately 180°. When the second energizing signal is the first energizing signal with a 180° phase shift, the transmission line conductors excited by the first energizing signal and the second energizing signal can be considered to be "symmetrical" with respect to a common ground of the EM wave generator 230, and in cases where the transport containers 220 are electrically grounded to the common ground of the EM wave generator 230, the transport container 220 as well. Symmetrical transmission line conductors can be advantageous for achieving a desired heating pattern along the length of the lossy transmission line.

In another embodiment, at least a first transmission line conductor of the lossy transmission line can be electrically grounded, at least a second transmission line conductor can be excited by a first energizing sign, and at least a third transmission line conductor can be excited by a second energizing signal. The second energizing signal can be the first energizing signal with a phase shift and/or symmetrical to the first energizing signal.

The excitation or energizing signals can be generated by EM wave generator 230 coupled by connection 232 to the transmission line conductors of the transport container 220. Connection 232 can be provided by at least one high voltage cable. Similar to intermediary connections 250, connection 232 can also include electrical components to achieve a desired reactive profile and/or a desired heating pattern. For example, connection 232 can include an electrical short, an electrical open, an inductive component, a capacitive component, and/or a reactive network.

The EM wave generator 230 generates the excitation or energizing signals providing EM power to the lossy transmission line. It will be understood that the excitation signals can be high frequency alternating current, alternating voltage, current waves, or voltage waves. The EM power can be a periodic high frequency signal having a fundamental frequency ($f_0$). The high frequency signal can have a sinusoidal waveform, square waveform, or any other appropriate shape. The high frequency signal can further include harmonics of the fundamental frequency. For example, the high frequency signal can include second harmonic $2f_0$, and third harmonic $3f_0$ of the fundamental frequency $f_0$. In some embodiments, the EM wave generator 230 can produce more than one frequency at a time. In some embodiments, the frequency and shape of the high frequency signal may change over time. The term "high frequency alternating current", as used herein, broadly refers to a periodic, high frequency EM power signal, which in some embodiments, can be a voltage signal.

The electrical power source 240 supplies electrical power to the EM wave generator 230. The electrical power source 240 can be any appropriate source of electrical power, such as a stand-alone electric generator, an electric generator, or a power converter for converting excess power from the transport vehicle 210 to electrical supply power suitable for the EM wave generator 230. For example, an electric generator can convert excess motive power from an engine of the transport vehicle 210 to the electrical supply power. In another example, a power converter can convert excess electrical power from the transport vehicle 210, such as a locomotive, to the electrical supply power suitable for the EM wave generator 230. The electrical supply power may be one of alternating current (AC) or direct current (DC). Power cables 242 carry the electrical supply power from the electrical power source 240 to the EM wave generator 230.

In at least one embodiment, the electrical power source 240 and the EM wave generator 230 can be both be transported with the transport containers 220. As shown in FIG. 2, the electrical power source 240 and the EM wave generator 230 can be located on board the transport vehicle 210, with the transport containers 220. In such cases, the hydrocarbons 102 can be heated during transport (e.g., on route from an initial location to a destination location). An apparatus with the EM wave generator 230 and the electrical power source 240 that are transportable with the transport containers 220 can be offer flexibility and convenience as the hydrocarbons 102 can be immediately unloaded upon arrival and can be unloaded at any destination location.

In at least another embodiment, the electrical power source 240 or both the electrical power source 240 and the EM wave generator 230 cannot be transported with the transport containers 220. For example, the electrical power source 240 and the EM wave generator 230 (indicated by dashed lines in FIG. 2) may not be located on board the transport vehicle 210. Instead, the electrical power source 240 or both the electrical power source 240 and the EM wave generator 230 can be located at the destination location. In such cases, the hydrocarbons 102 can be heated after arrival at the destination location and prior to unloading from the transport containers 220.

Figure 3:
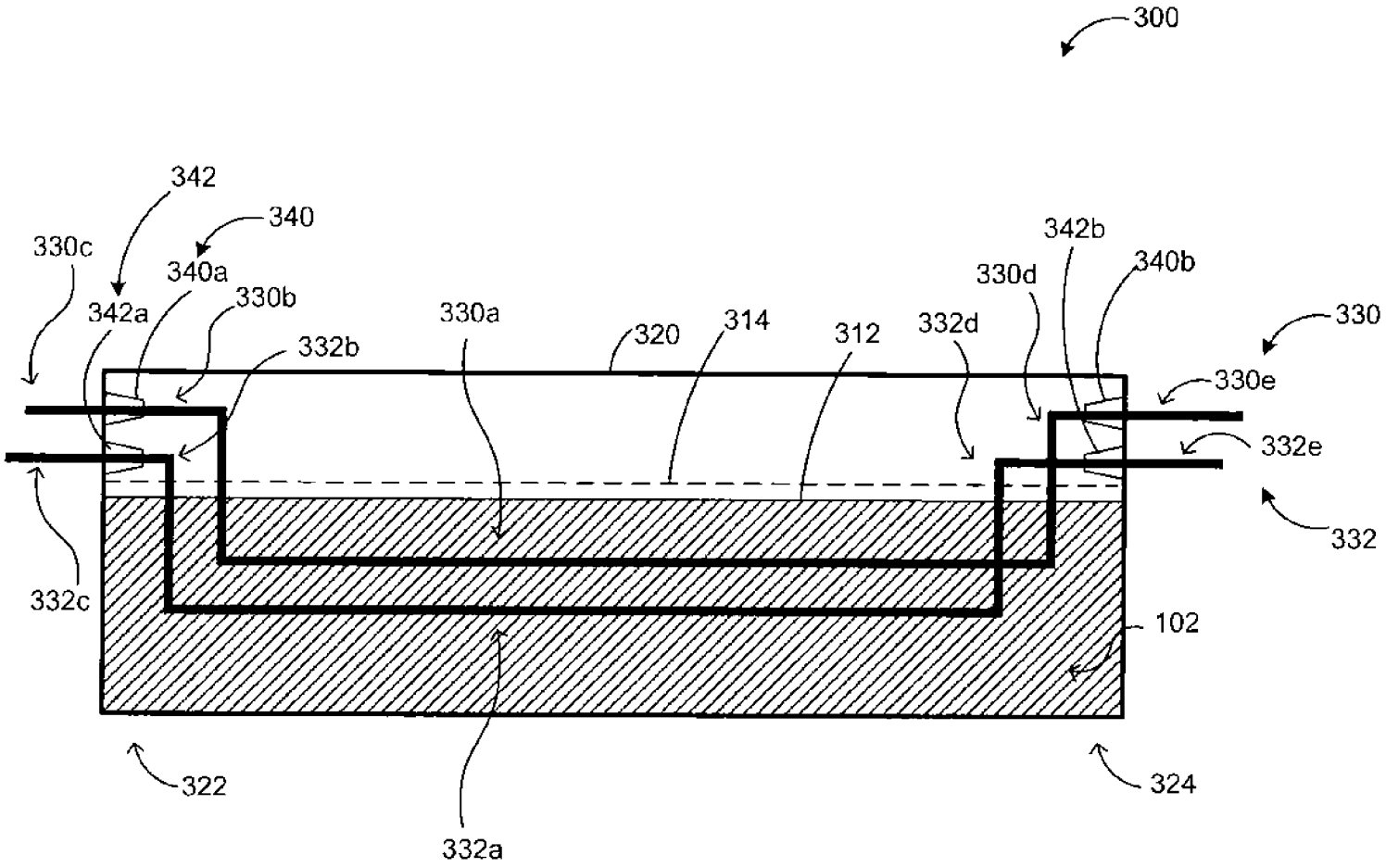
FIG. 3 is side profile view of another example apparatus including a plurality of horizontal electrodes, according to at least one embodiment.

Referring to FIG. 3, shown therein is a side profile view of an apparatus 300 for transporting hydrocarbons, according to at least one embodiment. The apparatus 300 includes a transport container 320 for storing the hydrocarbons 102. The transport container 320 can also be used in apparatus 200 of FIG. 2.

Similar to transport container 120, transport container 320 can be any appropriate container for storing hydrocarbons 102. Hydrocarbons 102 can be loaded into the transport container 320 to have a surface level 312.

The transport container 320 includes at least two transmission line conductors. In apparatus 300, the at least two transmission line conductors are provided by at least two electrodes 330 and 332. At least one excitation signal can be applied to the electrodes 330 and 332 to form a transmission line between the electrodes 330 and 332. Similar to apparatus 100, the transmission line of apparatus 300 can carry and dissipate energy within the hydrocarbons 102, which provides a dielectric between the electrodes 330 and 332. Thus, the transmission line formed by the electrodes 330 and 332 can be considered a lossy transmission line. The dissipation of electromagnetic energy within the hydrocarbons 102 can heat the hydrocarbons 102.

In apparatus 300, the transport container 320 does not provide one of the at least two transmission line conductors. However, the transport container 320 can be formed of a conductive material to provide electromagnetic shielding for the lossy transmission line. In addition, in at least one embodiment, the transport container 320 can be electrically grounded to a common ground as the EM wave generator providing the excitation signal, such as EM wave generator 230 of FIG. 2.

In apparatus 300, the transport container 320 includes at least two electrodes 330, 332 positionable in the transport container 320. Similar to electrode 130, the electrodes 330, 332 can be a conductor rod, a pipe (including coiled tubing) or any other conductor to transmit EM energy. Each electrode 330, 332 includes a heating portion 330*a*, 332*a* that is located in the transport container 320 and in physical contact with the hydrocarbons 102, connecting portions 330*c*, 330*e*, 332*c*, 332*e* that are located outside of the transport container 320, and transition portions 330*b*, 330*d*, 332*b*, 332*d* that traverse, or pass through the transport container 320 for connecting the heating portions 330*a*, 332*a* to the connecting portions 330*c*, 330*e*, 332*c*, 332*e*, respectively.

When positioned within the transport container 320, the electrodes 330, 332 extend substantially horizontally, between the first end 322 of the transport container 320 to the second end 324 of the transport container 320. The electrodes 330, 332 have a non-linear shape. More specifically, the electrodes 330, 332 each include bends between the heating portions 330*a*, 332*a* and the transition portions 330*b*, 332*b*, 330*d*, 332*d*. This allows the heating portions 330*a*, 332*b* of the electrodes 330, 332 to be positioned at a lower level than the transition portions 330*b*, 332*b*, 330*d*, 332*d*. As a result, heating portions 330*a*, 332*a* of the electrodes 330, 332 are immersed and in physical contact with the hydrocarbons 102 while the transition portions 330*b*, 332*b*, 330*d*, 332*d* are located above the surface level 312 of the hydrocarbons 102 to reduce the risk of leakage of hydrocarbons 102 from the transport container 120 at the transition portions 330*b*, 332*b*, 330*d*, 332*d*.

As shown in FIG. 3, surface level 312 of the hydrocarbons 102 is less than a pre-determined maximum level 314 of hydrocarbons 102 in the transport container 320. The pre-determined maximum level 314 may be based on the lowest level of the transition portions 330*b*, 332*b*, 330*d*, 332*d* of the electrodes 330, 332. By ensuring that the surface level 312 of the hydrocarbons 102 is less than a pre-determined maximum level 314, the risk of leakage of hydrocarbons 102 around the transition portion 330*b*, 332*b*, 330*d*, 332*d* can be reduced.

The electrodes 330, 332 of apparatus 300 is shown in FIG. 3 as being partially insulated 340, 342, respectively. In particular, only transition portions 330*b*, 330*d* of electrode 330 are insulated by insulating material 340 and transition portions 332*b*, 332*d* of electrode 332 are insulated by insulating material 342. It can be advantageous to insulate the transition portions 330*b*, 332*b*, 330*d*, 332*d* to reduce the risk of leakage of hydrocarbons 102 out of the transport container 320.

It should be noted that FIG. 3 is provided for illustrative purposes only and other configurations are possible. For example, transport container 320 can have a rectangular prism shape, a cylindrical shape (e.g., vertical or horizontal), or any other appropriate shape.

As well, while two electrodes 330, 332 are shown in FIG. 3, it will be understood transport container 320 can include fewer or more electrodes. While electrodes 330, 332 are shown as being approximately equally spaced within the transport container 320, the electrodes 330, 332 can have any appropriate spacing within the transport container 320 and between one another. Also, the two electrodes 330, 332 are shown as having substantially similar shapes. However, it will be understood that the two electrodes 330, 332 can have different shapes from one another. Although electrodes 330, 332 are shown as being partially insulated, it will be understood that electrodes 330, 332 can be fully insulated, or at least a portion of the heating portions 330*a*, 332*a* can be insulated.

While electrodes 330, 332 are shown as being non-linear and positioned horizontally within the transport container 420, it will be understood that electrodes 330, 332 can have a substantially linear shape and/or be positioned substantially vertical within the transport container 320. For example, the transition portions 330*b*, 332*b*, 330*d*, 332*d* are shown as passing through the first end 322 and the second end 324 of the transport container 320, in at least one embodiment, the transition portions 330*b*, 332*b*, 330*d*, 332*d* can pass through the top of the transport container 320.

Figure 4:
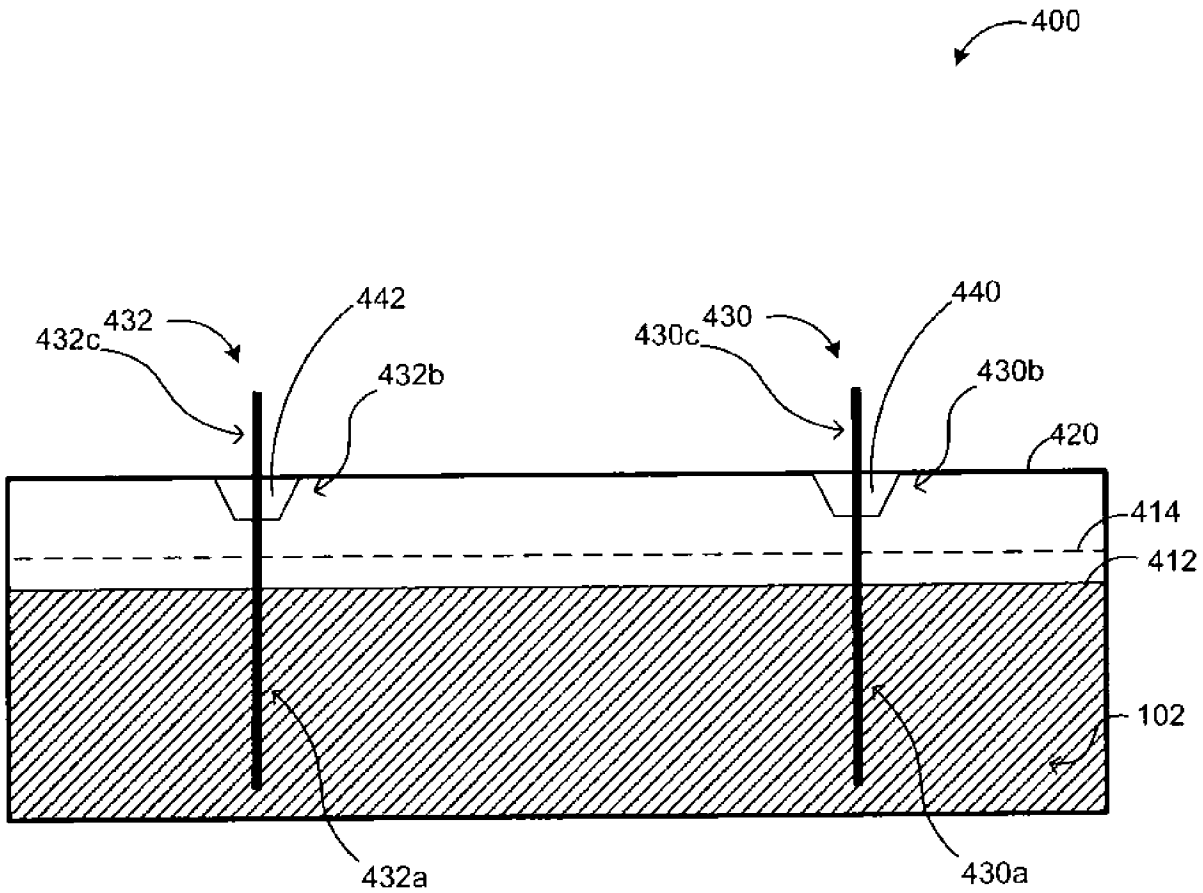
FIG. 4 is side profile view of another example apparatus including a plurality of vertical electrodes, according to at least one embodiment.

Referring to FIG. 4, shown therein is a side profile view of an apparatus 400 for transporting hydrocarbons, according to at least one embodiment. The apparatus 400 includes a transport container 420 for storing the hydrocarbons 102.

Similar to transport containers 120, 320, transport container 420 can be any appropriate container for storing hydrocarbons 102. Hydrocarbons 102 can be loaded into the transport container 420 to have a surface level 412 that is less than the pre-determined maximum level 414 of transport container 420.

Similar to transport containers 120 and 320, transport container 420 includes at least two transmission line conductors. Similar to apparatus 300, the transport container 420 does not provide one of the at least two transmission line conductors in apparatus 400. In apparatus 400, the at least two transmission line conductors are provided by at least two electrodes 430 and 432.

At least one excitation signal can be applied to the electrodes 430 and 432 to form a transmission line between the electrodes 430 and 432. Similar to apparatus 100 and 330, the transmission line of apparatus 400 can carry and dissipate energy within the hydrocarbons 102, which provides a dielectric between the electrodes 430 and 432. Thus, the transmission line formed by the electrodes 430 and 432 can be considered a lossy transmission line. The dissipation of electromagnetic energy within the hydrocarbons 102 can heat the hydrocarbons 102.

In apparatus 400, the transport container 420 includes at least two electrodes 430, 432 positionable in the transport container 420. Similar to electrodes 130, 330, 332, the electrodes 430, 432 can be a conductor rod, a pipe (including coiled tubing) or any other conductor to transmit EM energy.

When positioned within the transport container 420, the electrodes 430, 432 extend substantially vertically, from the top of the transport container 420 to the bottom of the transport container 420. The electrodes 430, 432 have a substantially linear shape. In at least one embodiment, the electrodes 430, 432 can have a non-linear shape, including bends or curves.

As shown in FIG. 4, each electrode 430, 432 includes a heating portion 430*a*, 432*a* that is located in the transport container 420 and in physical contact with the hydrocarbons 102, a connecting portion 430*c*, 432*c* that is located outside of the transport container 430, and a transition portion 430*b*, 432*b* that traverses, or passes through the transport container 420 for connecting the heating portion 430*a*, 432*a* to the connecting portion 430*c*, 432*c*, respectively.

In apparatus 400, the heating portions 430*a*, 432*a* of the electrodes 430, 432 are immersed in the hydrocarbons 102. As well, the transition portions 430*b*, 432*b* of the electrodes 430, 432 are located above the pre-determined maximum level 414 of the transport container 420, and in particular, the surface level 412 of the hydrocarbons 102. This configuration can reduce the risk of leakage of hydrocarbons 102 from the transport container 420 as the transition portions 430*b*, 432*b* pass through the transport container 420.

As shown in FIG. 4, the electrodes 430, 432 include only one connecting portion 430*c*, 432*c*, and as a result, only include one transition portion 430*b*, 432*b*, respectively. That is, the electrodes 430, 432 include only one terminal end.

Similar to electrodes 330, 332 of apparatus 300, the electrodes 430, 432 of apparatus 400 are shown in FIG. 4 as being partially insulated respectively. In particular, only transition portions 430*b*, 432*b* of electrodes 430, 432 are insulated by insulating material 440, 442, respectively. It can be advantageous to insulate the transition portions 430*b*, 432*b*, to reduce the risk of leakage of hydrocarbons 102 out of the transport container 420.

It should be noted that FIG. 4 is provided for illustrative purposes only and other configurations are possible. For example, transport container 420 can have a rectangular prism shape, a cylindrical shape (e.g., vertical or horizontal), or any other appropriate shape.

As well, while two electrodes 430, 432 are shown in FIG. 4, it will be understood transport container 420 can include fewer or more electrodes. While electrodes 430, 432 are shown as being approximately equally spaced within the transport container 420, the electrodes can have any appropriate spacing within the transport container 420 and between one another. Also, the two electrodes 430, 432 are shown as having substantially similar shapes. However, it will be understood that the two electrodes 430, 432 can have different shapes from one another. Although electrodes 430, 432 are shown as being partially insulated, it will be understood that electrodes 430, 432 can be fully insulated, or at least a portion of the heating portions 430*a*, 432*a* can be insulated.

While electrodes 430, 432 are shown as being positioned substantially linear and vertical within the transport container 420, it will be understood that electrodes 430, 432 can have a non-linear shape and/or be positioned substantially horizontal within the transport container 420. For example, the transition portions 430*b*, 432*b* are shown as passing through the top of the transport container 420, in at least one embodiment, the transition portions 430*b*, 432*b* can pass through an end of the transport container 420.

Figure 5:
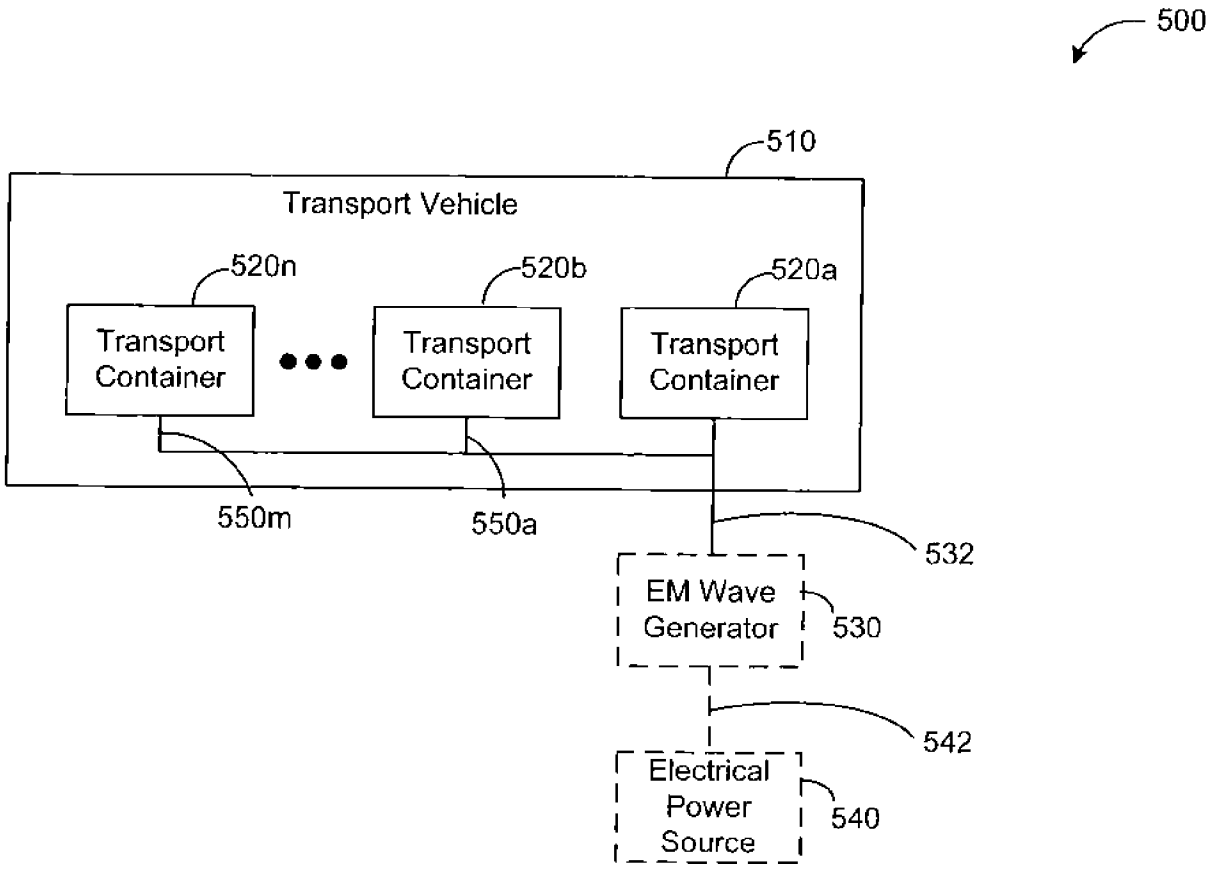
FIG. 5 is a schematic view of another example apparatus including a plurality of parallel transport containers, according to at least one embodiment.

Referring to FIG. 5, shown therein is a schematic view of an apparatus 500 for transporting hydrocarbons, according to at least another embodiment. The apparatus 500 includes a plurality of transport containers 520*a*, 520*b* . . . 520*n* (herein collectively referred to as transport containers 520). One or more of the transport containers 520 can be, for example, transport container 420 of FIG. 4.

The plurality of transport containers 520 can be transported together. As shown in FIG. 5, the plurality of transport containers 520 can be located on a transport vehicle 510. In at least another embodiment, the plurality of transport containers 520 can be rail cars coupled together.

As shown in FIG. 5, intermediary connection 550*a* of apparatus 500 couples transmission line conductors of transport container 520*b* to transmission line conductors of transport container 520*a* in a parallel connection. Intermediary connections can be provided by high voltage cables.

One or more of the intermediary connections 550 can include electrical components to achieve a desired reactive profile and/or a desired heating pattern at the lossy transmission lines of each transport container 520. For example, an intermediary connection 250 can include an electrical short, an electrical open, an inductive component, a capacitive component, and/or a reactive network.

As described above, the at least two transmission line conductors of the lossy transmission line can be excited to electromagnetically heat the hydrocarbons 102 prior to unloading the hydrocarbons 102 from the transport container 520. One or more excitation or energizing signals can be used to excite the transmission line conductors.

The excitation or energizing signals can be generated by an electromagnetic (EM) wave generator 530 coupled by connection 532 to the transmission line conductors of the transport container 520*a*. Connection 532 can be provided by at least one high voltage cable. Similar to intermediary connections 550, connection 532 can also include electrical components to achieve a desired reactive profile and/or a desired heating pattern. For example, connection 532 can include an electrical short, an electrical open, an inductive component, a capacitive component, and/or a reactive network.

Similar to the EM wave generator 230 of apparatus 200, the EM wave generator 530 of apparatus 500 generates the excitation or energizing signals providing EM power to the lossy transmission lines.

Similar to the electrical power source 240 of apparatus 200, the electrical power source 540 of apparatus 500 supplies electrical power to the EM wave generator 530. The electrical power source 540 can be any appropriate source of electrical power. Power cables 542 carry the electrical power from the electrical power source 540 to the EM wave generator 530.

In at least one embodiment, the electrical power source 540 or both the electrical power source 540 and the EM wave generator 530 cannot be transported with the transport containers 520. For example, the electrical power source 540 and the EM wave generator 530 are not located on board the transport vehicle 510. Instead, the electrical power source 540 or both the electrical power source 540 and the EM wave generator 530 (shown in dashed lines in FIG. 5) can be located at the destination location. In such cases, the hydrocarbons 102 can be heated after arrival at the destination location and prior to unloading from the transport containers 520.

In at least another embodiment, the electrical power source 540 and the EM wave generator 530 can be both be transported with the transport containers 520. The electrical power source 540 and the EM wave generator 530 can both be located on board the transport vehicle 510, with the transport containers 520. In such cases, the hydrocarbons 102 can be heated during transport (e.g., on route from an initial location to a destination location). An apparatus with the EM wave generator 530 and the electrical power source 540 that are transportable with the transport containers 520 can be offer flexibility and convenience as the hydrocarbons 102 can be immediately unloaded upon arrival and can be unloaded at any destination location.

It should be noted that FIG. 5 is provided for illustrative purposes only and other configurations are possible. For example, only one transport container 520 is shown in each parallel branch. However, in at least one embodiment, at least one parallel branch can include a plurality of daisy chained transport containers 520. For example, a plurality of daisy chained transport containers 520 can be connected at intermediary connection 550*m*.

Figure 6:
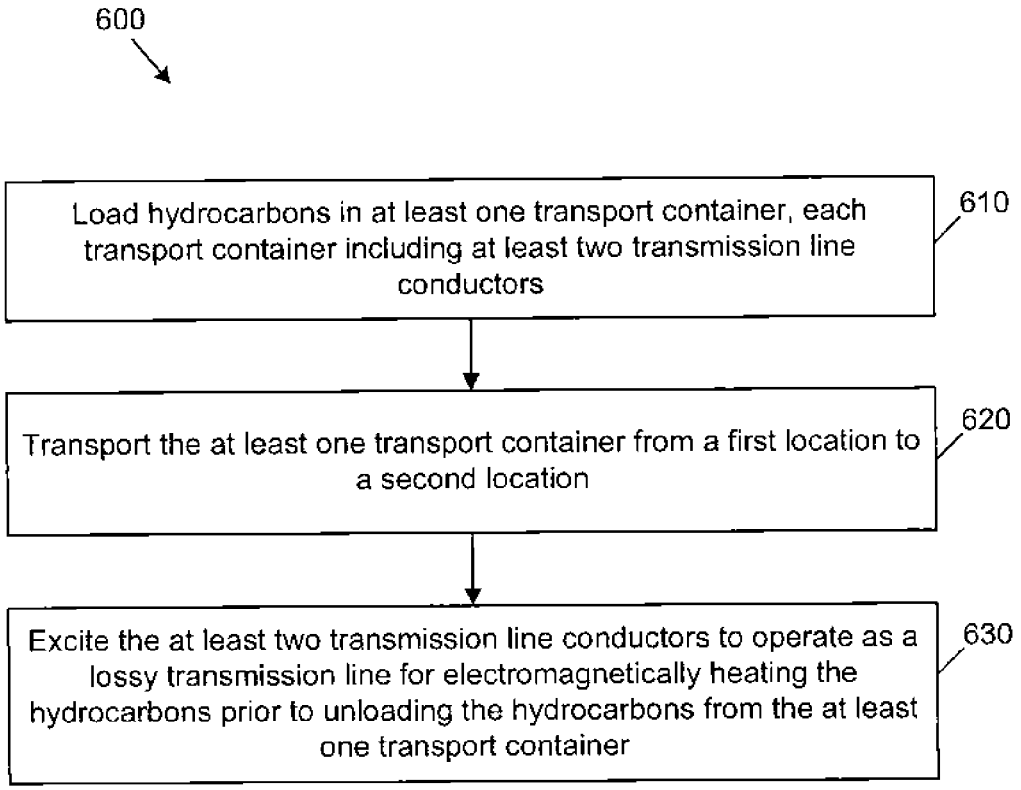
FIG. 6 is a flowchart diagram of an example method for transporting hydrocarbons, in accordance with at least one embodiment.

Referring now to FIG. 6, shown therein is a flowchart diagram of an example method 600 for transporting hydrocarbons, in accordance with at least one embodiment.

Method 600 begins at 610 with loading the hydrocarbons in at least one transport container. The transport container can be, for example, transport container 120, 220, 320, 420, or 520 of FIGS. 1-5, respectively. Each of the at least one transport container includes at least two transmission line conductors configurable to be in physical contact with the hydrocarbons, such as hydrocarbons 102.

In at least one embodiment, loading the hydrocarbons 102 in at least one transport container at 610 can further involve closing the transport container after the transport container is loaded with hydrocarbons 102. In at least one embodiment, loading the hydrocarbons in at least one transport container at 610 can involve filling the transport container to a level less than a pre-determined maximum level within the transport container. For example, the transport containers can be filled with hydrocarbons having a surface level of 112, 312, or 412. The surface level of the hydrocarbons 312 or 412 can be less than a pre-determined maximum level of 314 and 414.

In at least one embodiment, loading the hydrocarbons in the at least one transport container can involve loading the hydrocarbons in a plurality of transport containers, such as transport containers 220, 520, and coupling the at least two transmission line conductors of at least a pair of transport containers in either a series connection, such as intermediary connections 250 or a parallel connection, such as intermediary connections 550. Furthermore, coupling the at least two transmission line conductors of at least a pair of transport containers can involve coupling the at least two transmission line conductors of a plurality of transport containers in series connections to lengthen the lossy transmission line.

In at least one embodiment, loading the hydrocarbons in at least one transport container at 610 can further involve providing an additive for at least one of increasing conductivity and increasing dielectric losses. For example, the additive can be carbon black.

At 620, the method involves transporting the at least one transport container from a first location to a second location. The first location can be an initial or source location of the hydrocarbons 102, such as a hydrocarbon formation from which the hydrocarbons 102 are extracted. The second location can be the destination location of the hydrocarbons 102, such as a market for the hydrocarbons 102.

At 630, the method involves exciting the at least two transmission line conductors of the at least one transport container to operate as a lossy transmission line for electromagnetically heating the hydrocarbons prior to unloading the hydrocarbons from the at least one transport container. It should be noted that act 630 can be performed during act 620 or after 620.

In at least one embodiment, exciting the at least two transmission line conductors at 630 can involve positioning at least one electrode in the transport container. The at least one electrode can be, for example, electrode 130, 330, 332, 430, or 432. Furthermore, positioning at least one electrode in the transport container can involve positioning at least a first electrode, such as electrode 330 or 430, and a second electrode such as electrode 332 or 432, in the transport container; exciting the first electrode by a first energizing signal; and exciting the second electrode by a second energizing signal. The second energizing signal can be the first energizing signal with a phase shift. In at least one embodiment, the phase shift between the first energizing signal and the second energizing signal is 180°.

In at least one embodiment, positioning at least one electrode in the transport container can involve immersing at least a heating portion of the at least one electrode in the hydrocarbons 102. For example, the heating portion can be 130*a*, 330*a*, 332*a*, 430*a*, or 432*a*.

In at least one embodiment, coupling the at least two transmission line conductors of at least a pair of transport containers further can involve providing at least one of an electrical short, an electrical open, an inductive component, a capacitive component, and a reactive network in the connection between the pair of transport containers to achieve a desired reactive profile along the length of the lossy transmission line. In at least one embodiment, coupling the at least two transmission line conductors of at least a pair of transport containers further can involve providing at least one of an electrical short, an electrical open, an inductive component, a capacitive component, and a reactive network at a terminal end of the lossy transmission line to achieve a desired reflection profile at the termination of the lossy transmission line. For example, an electrical short, an electrical open, an inductive component, a capacitive component, and a reactive network can be provided at connections 250, 550, or terminal ends of transport containers 220*n*, 520.

In at least one embodiment, exciting the at least two transmission line conductors at 630 can involve coupling at least one electromagnetic wave generator to the at least two transmission line conductors. The at least one electromagnetic wave generator can be, for example EM wave generators 230 or 530. In addition, coupling at least one electromagnetic wave generator to the at least two transmission line conductors can involve electrically grounding the transport container to a common ground as the at least one EM wave generator.

In at least one embodiment, the at least one electromagnetic wave generator is located at the second location; and coupling the at least one electromagnetic wave generator to the at least two transmission line conductors is performed at the second location. In such cases, electromagnetic heating can only take place after the transport container has been transported to the second location. That is, in such cases, act 630 occurs after act 620.

In at least one embodiment, exciting the at least two transmission line conductors can involve coupling an electrical power source located at the second location to the at least one electromagnetic wave generator coupled to the at least two transmission line conductors. The electrical power source can be, for example, electrical power source 240 or 540.

In at least one embodiment, electromagnetically heating the hydrocarbons is performed during at least a portion of the transportation of the at least one transport container between the first location and the second location. That is, in such cases, act 630 can occur during at least part of act 620.

In at least one embodiment, exciting the at least two transmission line conductors at 630 can involve converting excess power to electrical supply power for the at least one electromagnetic wave generator. In such cases, act 630 can occur during at least part of act 620.

In some cases, the teachings herein can be directed at apparatus and methods for transporting solid and semi-solid substances other than hydrocarbons. For example, hazardous materials such as caustic substances can be transported in solid or semi-solid form and electromagnetically heated to liquid form for unloading or use.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments. Furthermore, this description is not to be considered as limiting the scope of these embodiments in any way, but rather as merely describing the implementation of these various embodiments.

The invention claimed is:

1. An apparatus for transporting solid and/or semi-solid substances, the apparatus comprising at least one transport container for storing the substance, the transport container comprising at least two transmission line conductors configurable to be in physical contact with the substance, the at least two transmission line conductors being excitable to operate as a lossy transmission line for electromagnetically heating the substance prior to unloading the substance from the transport container.

2. The apparatus of claim 1, wherein electromagnetically heating the substance comprises transmitting electromagnetic energy to the substance to heat the substance volumetrically.

3. The apparatus of claim 1, wherein the transport container is closable.

4. The apparatus of claim 1, wherein the at least two transmission line conductors comprise at least one electrode positionable in the transport container.

5. The apparatus of claim 4, wherein the transport container is formed of a conductive material to provide electromagnetic shielding for the lossy transmission line.

6. The apparatus of claim 4, wherein the at least one electrode positionable in the transport container comprises at least a first electrode that is electrically grounded and at least a second electrode excitable by at least a first energizing signal.

7. The apparatus of claim 6, wherein the at least a second electrode excitable by at least a first energizing signal further comprises at least a third electrode excitable by at least a second energizing signal, the second energizing signal being the first energizing signal with a 180° phase shift.

8. The apparatus of claim 4, wherein the at least one electrode positionable in the transport container comprises at least a first electrode excitable by at least a first energizing signal and at least a second electrode excitable by at least a second energizing signal, the second energizing signal being the first energizing signal with a 180° phase shift.

9. The apparatus of claim 4, wherein the at least one electrode positionable in the transport container comprises at least a heating portion of the at least one electrode being immersed in the substance when the at least one electrode is positioned in the transport container.

10. The apparatus of claim 9, wherein the at least one electrode comprises at least one connecting portion located outside of the transport container when the electrode is positioned in the transport container.

11. The apparatus of claim 10, wherein the at least one electrode comprises a transition portion for coupling the heating portion to the connecting portion, the transition portion entering the transport container above a pre-determined level within the transport container when the electrode is positioned in the transport container.

12. The apparatus of claim 11, further comprising insulating material around at least the transition portion of each of the at least one electrode.

13. The apparatus of claim 9, further comprising insulating material around at least the heating portion of each of the at least one electrode.

14. The apparatus of claim 4, wherein the transport container is configurable as a transmission line conductor of the at least two transmission line conductors, the transport container being formed of a conductive material.

15. The apparatus of claim 1, wherein:

the at least one transport container comprises a plurality of transport containers; and the apparatus further comprises at least one intermediary connection for coupling the at least two transmission line conductors of at least a pair of transport containers in either a series connection or a parallel connection.

16. The apparatus of claim 15, wherein the at least one intermediary connections for coupling the at least two transmission line conductors comprises a plurality of intermediary connections for coupling the at least two transmission line conductors of a plurality of transport containers in series connections to lengthen the lossy transmission line.

17. The apparatus of claim 16, wherein a total length of the lossy transmission line is at least 50 meters.

18. The apparatus of claim 15, wherein the at least one intermediary connection further comprises at least one of an electrical short, an electrical open, an inductive component, a capacitive component, and a reactive network to achieve a desired reactive profile along the length of the lossy transmission line.

19. The apparatus of claim 15, further comprising at least one of an electrical short, an electrical open, an inductive component, a capacitive component, and a reactive network at a terminal end of the lossy transmission line to achieve a desired reflection profile at the termination of the lossy transmission line.

20. The apparatus of claim 1 further comprising at least one electromagnetic wave generator couplable to the at least two transmission line conductors for exciting the at least two transmission line conductors.

21. The apparatus of claim 20 wherein the at least one electromagnetic wave generator is transportable with the at least one transport container.

22. The apparatus of claim 20, wherein the transport container is electrically grounded to a common ground as the at least one electromagnetic wave generator.

23. The apparatus of claim 20, further comprising at least one high voltage cable for coupling the at least one electromagnetic wave generator to the at least two transmission line conductors.

24. The apparatus of claim 20, further comprising an electrical power source couplable to the at least one electromagnetic wave generator for supplying electrical power to the at least one electromagnetic wave generator.

25. The apparatus of claim 24, wherein the electrical power source is transportable with the at least one transport container.

26. The apparatus of claim 25, wherein the electrical power source comprises at least one of an electric generator and a power converter for converting excess power to the electrical power supplied to the at least one electromagnetic wave generator.

27. The apparatus of claim 1, wherein the substance further comprises an additive for at least one of increasing conductivity and increasing dielectric losses.

* * * * *